US007520333B2

(12) United States Patent
Turner et al.

(10) Patent No.: US 7,520,333 B2
(45) Date of Patent: Apr. 21, 2009

(54) HYDRAULIC SLEEVE VALVE WITH POSITION INDICATION, ALIGNMENT, AND BYPASS

(75) Inventors: Dewayne M. Turner, Tomball, TX (US); Richard J. Ross, Houston, TX (US); Kenneth E. Rozek, Houston, TX (US); Todd Chretien, Lafayette, LA (US)

(73) Assignee: BJ Services Company, Houston, TX (US)

( * ) Notice: Subject to any disclaimer, the term of this patent is extended or adjusted under 35 U.S.C. 154(b) by 200 days.

(21) Appl. No.: 11/558,812

(22) Filed: Nov. 10, 2006

(65) Prior Publication Data

US 2007/0119594 A1 May 31, 2007

Related U.S. Application Data

(60) Provisional application No. 60/735,385, filed on Nov. 11, 2005.

(51) Int. Cl.
*E21B 43/00* (2006.01)

(52) U.S. Cl. ..... 166/375; 166/334.4

(58) Field of Classification Search ..... 166/334.4, 166/375, 319, 321

See application file for complete search history.

(56) References Cited

U.S. PATENT DOCUMENTS 4,768,598 A * 9/1988 Reinhardt ..... 175/26
7,337,846 B2 * 3/2008 Restarick et al. ..... 166/313
7,367,393 B2 * 5/2008 Vachon ..... 166/250.01

* cited by examiner

*Primary Examiner*—William P Neuder
(74) *Attorney, Agent, or Firm*—Zarian Midgley & Johnson PLLC

(57) ABSTRACT

A hydraulic sleeve valve is disclosed that comprises a bypass relief system that provides an indication that the valve has reached a predetermined position, such as, for example, the fully opened or fully closed condition. The bypass relief may also provide a valve control fluid circulation function to filter or otherwise manipulate the control fluid. Also disclosed are flow port alignment systems that maintain the valve flow ports in predetermined relationships.

20 Claims, 10 Drawing Sheets

| | 1 | 2 | | | | 630 | 650 | 3 | 640 | | |
|---|---|---|---|---|---|---|---|---|---|---|---|
| | SHIFTING OBJECTIVE | CURRENT POSITION | | | | | | | VALVE SHIFTING SEQUENCE | | |
| | | LOWER | UPPER | VENT | APPLY PSI | CONTROL LINE DISPLACEMENT | MONITOR | VENT | APPLY PSI | SHIFTING DISPLACEMENT |
| A | I-II | CLOSED | CLOSED | ACL | 3000 PSI RSSR | | RSSL/RSSU | ACL | 3000 PSI RSSL | 513 CC/RSSR INITIAL |
| B | I-III | CLOSED | CLOSED | ACL | 3000 PSI RSSR | | RSSL/RSSU | ACL | 3000 PSI RSSU | 513 CC/RSSR INITIAL |
| C | I-IV | CLOSED | CLOSED | ACL | 3000 PSI RSSR | | RSSL/RSSU | ACL | 3000 PSI RSSL/RSSU | 1025 CC/RSSR INITIAL |
| D | II-I | OPEN | CLOSED | ACL | 3000 PSI RSSL | RSSL/RSSR 2 GAL/1000' | | ACL | 3000 PSI RSSR | 513 CC/RSSL POSITIVE |
| E | II-III | OPEN | CLOSED | ACL | 3000 PSI RSSL | RSSL 1 GAL/1000' | | ACL | 3000 PSI RSSR | 513 CC/RSSL POSITIVE |
| F | II-IV | OPEN | CLOSED | ACL | 3000 PSI RSSL | RSSL 1 GAL/1000' | | | 3000 PSI RSSU | 513 CC/RSSR INITIAL |
| G | III-I | CLOSED | OPEN | ACL | 3000 PSI RSSU | RSSL/RSSR 2 GAL/1000' | | ACL | 3000 PSI RSSR | 513 CC/RSSU POSITIVE |
| H | III-III | CLOSED | OPEN | ACL | 3000 PSI RSSU | RSSL 1 GAL/1000' | | ACL | 3000 PSI RSSR | 513 CC/RSSU POSITIVE |
| I | III-IV | CLOSED | OPEN | ACL | 3000 PSI RSSU | RSSL 1 GAL/1000' | | | 3000 PSI RSSL | 513 CC/RSSR INITIAL |
| J | IV-I | OPEN | OPEN | ACL | 3000 PSI RSSL/RSSU | RSSL/RSSU/RSSR 3 GAL/1000' | | ACL | 3000 PSI RSSR | 1026 CC/RSSL; RSSU POSITIVE |
| K | IV-III | OPEN | OPEN | ACL | 3000 PSI RSSU | RSSU 1 GAL/1000' | | ACL | 3000 PSI RSSR | 1026 CC/RSSL; RSSU POSITIVE |
| L | IV-IV | OPEN | OPEN | ACL | 3000 PSI RSSL | RSSL 1 GAL/1000' | | ACL | 3000 PSI RSSR | 1026 CC/RSSL; RSSU POSITIVE |

FIG. 10A

| VALVE SHIFTING SEQUENCE | | | | | | 4 FINAL POSITION | |
|---|---|---|---|---|---|---|---|
| CONTROL LINE DISPLACEMENT | VENT | APPLY PSI | SHIFTING DISPLACEMENT | CONTROL LINE DISPLACEMENT | VENT | LOWER | UPPER |
| RSSL/RSSR 2 GAL/1000' | ACL | | | | | OPEN | CLOSED |
| RSSU/RSSR 2 GAL/1000' | ACL | | | | | CLOSED | OPEN |
| RSSU/RSSR 2 GAL/1000' | ACL | | | | | OPEN | OPEN |
| | ACL | | | | | CLOSED | CLOSED |
| | ACL | 3000 PSI RSSU | 513 CC/RSSR INITIAL | RSSU/RSSR 2 GAL/1000' | ACL | CLOSED | OPEN |
| RSSU/RSSR 2 GAL/1000' | ACL | | | | ACL | OPEN | OPEN |
| | ACL | | | | | CLOSED | CLOSED |
| | ACL | 3000 PSI RSSL | 513 CC/RSSR INITIAL | RSSL/RSSR 2 GAL/1000' | ACL | OPEN | CLOSED |
| RSSL/RSSR 2 GAL/1000' | ACL | | | | | OPEN | OPEN |
| | ACL | | | | | CLOSED | CLOSED |
| | ACL | 3000 PSI RSSL | 513 CC/RSSR INITIAL | RSSL/RSSR 2 GAL/1000' | ACL | OPEN | CLOSED |
| | ACL | 3000 PSI RSSU | 513 CC/RSSR INITIAL | RSSU/RSSR 2 GAL/1000' | ACL | CLOSED | OPEN |

*FIG. 10B*

HYDRAULIC SLEEVE VALVE WITH POSITION INDICATION, ALIGNMENT, AND BYPASS

CROSS REFERENCE TO RELATED APPLICATIONS

This application claims priority to and benefit of U.S. Provisional Patent Application Ser. No. 60/735,385 filed on Nov. 11, 2005.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The invention relates generally to completion equipment and operations in subterranean wells and, more specifically, to a hydraulically operated sleeve valve that provides selective and controlled regulation of fluids within a tubing string in subterranean installations.

2. Description of the Related Art

Mechanical sleeve valves, such as BJ Services Company's family of Multi-Service Valves, are used in subterranean wells to provide zone isolation and bore completion control for completion operations such as gravel packing, spot acidizing and fracturing, killing a well, or directing flow from the casing to the tubing in alternate or selective completion operations. In such operations, the sleeve valve provides fluid communication between the tubing string, such as the inner diameter of the valve, and the outside of the valve, such as a well annulus. Typically, mechanical sleeve valves are opened or closed, such as by a shifting tool that is placed within the valve body and manipulated by standard wireline and/or coiled tubing methods. The sleeve, which seals the fluid communication path, can be physically moved from the closed to opened position, and vice versa, by these methods.

There also exist hydraulically actuated sleeve valves, such as WellDynamics' CC Interval Control Valve, in which opening and closing of the valve is achieved remotely with the use of two hydraulic control lines. In these types of hydraulic sleeve valves, a pressure differential across a defined piston area causes the sleeve to move in the desired direction.

Unlike mechanical sleeve valves, hydraulic sleeve valves typically do not provide a positive indication that the sleeve has been actuated to the fully opened condition or the fully closed condition. Debris, mechanical damage, and other such events or artifacts may prevent the valve from fully opening or fully closing at the rated pressure differential. Further, the oftentimes-severe conditions at the control site (such as, for example, sub sea) may allow precipitates to form in the control fluid (e.g., hydraulic oil) that may adversely affect opening or closing of the sleeve valve. Gases also may be introduced into the control lines, which also may adversely affect valve operation.

Applicants have invented an improved hydraulic sleeve valve that provides positive indication of the valve position, circulation of control fluid to eliminate or reduce control line contaminants, and/or positive alignment of the valve flow ports.

BRIEF SUMMARY OF THE INVENTION

The present inventions provide a hydraulic valve assembly for use in a subterranean well comprising a body portion including a flow port therethrough. A sleeve is axially and slidably disposed adjacent an inside surface of the body portion and forms a sealed pressure chamber there between. The sleeve comprises a working surface that is disposed in the pressure chamber and separates the chamber into a valve opening. portion and a valve closing portion. A flow port may be located through a portion of the sleeve such that when the body flow port and the sleeve flow port are aligned, the valve permits fluid communication from outside of the body to inside of the sleeve. A bypass relief system may be provided to fluidly communicate between the valve opening and closing portions of the chamber when the sleeve is in a predetermined axial position.

Another aspect of the present inventions provides a bypass relief system comprising a one-way pressure relief valve disposed in a bypass conduit having an opening pressure port and a closing pressure port, both of which communicate with the pressure chamber.

Another aspect of the present inventions provides a flow port alignment system, disposed between the sleeve and the body to prevent the sleeve from rotating relative to the body, thereby maintaining a predetermined alignment of the body port and the sleeve port.

Another aspect of the present inventions provides a flow port alignment system that comprises a sleeve position indexing system including a programmed track and follower for axially and/or rotationally positioning the sleeve relative to the body port at a plurality of flow conditions.

Another aspect of the present invention provides a method for valving fluid flow in a subterranean well, which comprises: providing a hydraulic sleeve valve at desired location in the well; supplying fluid pressure to the valve to change its flow condition from closed to opened or opened to closed; and generating an indication with the bypass relief system to inform the valve user that the valve has cycled to the desired flow condition, where the hydraulic sleeve valve comprises a body portion including a flow port therethrough, a sleeve axially slidably disposed adjacent an inside surface of the body portion and forming a sealed pressure chamber there between; the sleeve comprising a working surface disposed in the pressure chamber and separating the chamber into a valve opening portion and a valve closing portion; and a bypass relief system adapted to fluidly communicate between the valve opening and closing portions of the chamber when the sleeve is in a predetermined axial position.

BRIEF DESCRIPTION OF THE SEVERAL VIEWS OF THE DRAWINGS

The following figures form part of the present specification and are included to further demonstrate certain aspects of the present invention. The invention may be better understood by reference to one or more of these figures in combination with the detailed written description of specific embodiments presented herein.

FIGS. 10A and 10B illustrate a shifting sequence chart for the downhole assembly of FIG. 9.

Figure 1:
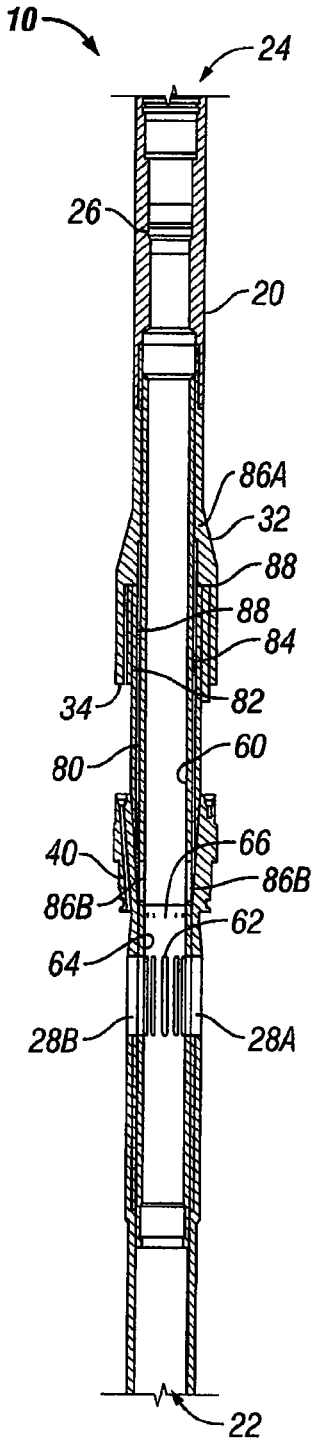
FIG. 1 illustrates a sectional view of a preferred embodiment of a hydraulic sleeve valve incorporating various aspects of the present inventions.

While the inventions disclosed herein are susceptible to various modifications and alternative forms, only a few specific embodiments are shown by way of example in the drawings and are described in detail below. The figures and detailed descriptions of these specific embodiments are not intended to delimit all embodiments of the invention or to limit the breadth or scope of the inventive concepts or the appended claims in any manner. Rather, the figures and detailed written descriptions are provided to illustrate the inventive concepts to a person of skill in the art.

DETAILED DESCRIPTION

One or more illustrative embodiments incorporating the inventions disclosed herein are presented below. Not all features of an actual implementation are necessarily described or shown for the sake of clarity. For example, the various seals, vents, joints and others design details common to oil well equipment are not specifically illustrated or described. It is understood that in the development of an actual embodiment incorporating the present invention, numerous implementation-specific decisions must be made to achieve the developer's goals, such as compliance with system-related, business-related, government-related, and other constraints, which vary by implementation and from time to time. While a developer's efforts might be complex and time-consuming, such efforts would be, nevertheless, a routine undertaking for those of ordinary skill in the art having benefit of this disclosure.

As used within this description, relative and positional terms, such as, but not limited to "up" and "down"; "upward" and downward "upstream" and "downstream"; "upper" and "lower"; "upwardly" and "downwardly"; and other like terms are used in this description to more clearly describe some embodiments of the invention. However, when applied to apparatus and methods for use in wells that are deviated or horizontal, such terms may refer to a left to right, right to left, or other relationship as appropriate. Also, as used herein the terms "seal" and "isolation" are used with the recognition that some leakage may occur and that such leakage may be acceptable. Thus, some embodiments of the present invention may allow for leakage without departing from the scope of the invention and systems that provide for such leakage and fall within the scope of the present invention In general, Applicants have invented an improved hydraulic sleeve valve for use in subterranean wells. The valve comprises a body having a plurality of flow ports allowing communication from outside the body to inside the body. A movable sleeve may be sealed to the inside of the body such that in one position the sleeve prevents flow through the body flow ports and in another position flow therethrough is facilitated. The sleeve may be moved from the closed position to the opened position (and vice versa) by a pressure differential, such as that created by control line hydraulic pressure, which may be applied to one or more piston areas associated with the sleeve. The valve may comprise one or more position indicators to indicate, for example, that the sleeve has been moved into the fully opened flow condition. Such position indicators may comprise a pressure bypass conduit that is uncovered (i.e., opened to fluid communication) as the sleeve reaches the fully opened conditioned. When the bypass conduit is uncovered, fluid communication among the open and close control lines in the valve and the pressure control equipment is established. Additionally, once uncovered, the bypass conduit may be used to circulate the actuating fluid, such as hydraulic fluid, through the valve and control system to, among other things, remove contaminants such as air, gas, water, or particulates. Still further, the valve body and the sleeve may comprise a port alignment system to maintain the body ports and sleeve ports, if any, in a desired flow alignment.

Turning now to a more specific discussion of a particular embodiment of the present inventions, FIG. 1 illustrates a preferred embodiment of a hydraulically operated sleeve valve 10 incorporating various aspects of the present inventions. It will be appreciated that what is illustrated and described with reference to FIG. 1 is not the only possible embodiment that incorporates various aspects of the present inventions. Thus, it must be understood that the specific features depicted and described herein are not meant to limit the breadth of the appended claims. Valve 10 generally comprises a body 20 having a distal end 22 and a proximal end 24. Both the proximal and distal ends 24, 22 may comprise coupling systems, such as, but not limited to, threaded connections. The proximal end 24 may also comprise a landing nipple, such as, but not limited to, a type "X" or type "R" landing nipple. The valve body 20 may also comprise manifold portions 40, 32. The valve body 20 also comprises a plurality of fluid ports 28 (two ports 28A, 28B are shown) that permit fluid communication from outside the valve body 20 (such as from a well annulus) to the inside surface 64 of the valve body 20. It is preferred that the cumulative flow area of the flow ports 28 be at least the same as, and more preferably larger than, the flow area of the tubing string. Those persons of skill in this art are adept at locating, sizing, and selecting the number of body flow ports 28 needed in any given application.

Disposed within the valve body 20 is a sleeve 60, which is substantially unrestrained to move in a substantially axial direction, i.e., toward and away from the distal and proximal ends 22, 24. The sleeve 60 comprises plurality of flow ports 62. It is likewise preferred that the cumulative flow area of the sleeve flow ports 62 substantially match the flow area of body ports 28. As will be discussed later, it may be important in some embodiments of the present invention to maintain alignment between the body flow ports 28 and the sleeve flow ports 62 so that undesired flow restrictions and/or pressure drops are avoided. FIG. 1 illustrates the valve 10 in the "opened" condition and it will be appreciated that fluid is thus allowed to communicate from outside the valve 10 (again, such as a well annulus) to the inside surface 64 of the sleeve 60 and, therefore, valve 10. The sleeve 60 may also comprise a plurality of equalizing ports 66 that function to reduce any pressure differential that may damage the valve 10 seal systems during opening and/or closing of the valve 10. It should be noted that the sleeve 60 may or may not contain flow ports 62 therethrough. For example, sleeve 60 may simply comprise a flow-restricting portion that prevents flow through the body flow ports in one position and not in another position.

Focusing now on the interface between the body 20 and the sleeve 60, FIG. 1 illustrates that an elongated pressure chamber 80 is formed there between. In the embodiment illustrated in FIG. 1, the valve body 20 has appropriate recesses formed adjacent its inside diameter surface to create the chamber 80 when the sleeve 60 is located in the valve 10. Alternately, the chamber 80 may be formed by recesses in the outer surface of the sleeve 60 or by a combination of recesses in both the body 20 and sleeve 60. It will be appreciated that the chamber 80 is substantially sealed against pressure loss and/or gas infiltration by one or more seal systems 86. Seal systems suitable for this function are well known in the art and include, but are not limited to metal seal systems and non-metal seal systems, such as those made from PEEK, PEKK, PTFE, and elastomers, or a combination thereof.

Disposed within the chamber 80 is one or more working surfaces 82 that are coupled, integrally or otherwise, to the sleeve 60. Pressure in the chamber 80, or more accurately, differential pressure across the working surface 82 causes the sleeve 60 to move substantially axially in the direction of low pressure. In the preferred embodiment illustrated in FIG. 1, the working surfaces 82 comprise a pair of seal-retaining rings 84 disposed on either side of a seal shoulder 90 (see FIG. 2). Disposed between the seal shoulder 90 and the retaining rings 84 are seal systems 88, which may be of a type described above for seal system 86. The retaining rings 84 are pinned or otherwise coupled to the outside surface of the sleeve 60. It will be appreciated that in the embodiment illustrated in FIG. 2, one of the rings 84 provides an opening working surface while the other ring 84 provides a closing working surface within the chamber 80.

The embodiment illustrated in FIG. 1 is an "up-to-open" valve, meaning that the sleeve 60 must be moved toward the proximal end 24 to align the body flow ports 28 and sleeve flow ports 62 for fluid communication. It must be understood that embodiments of the present invention are not limited to "up-to-open" arrangements and may also comprise "up-to-close" arrangements, as desired.

Figure 2A:
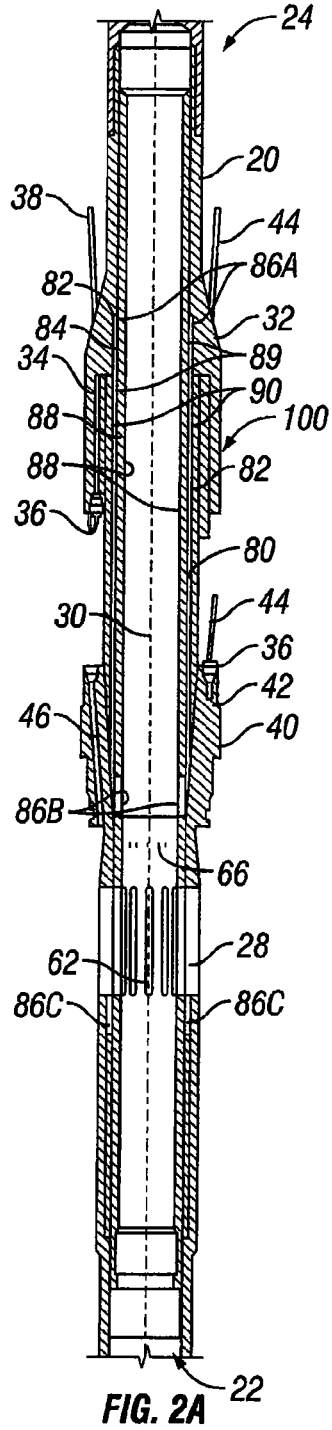
FIGS. 2A-2B are sectional views of a portion of the valve illustrated in FIG. 1.
Figure 2B:
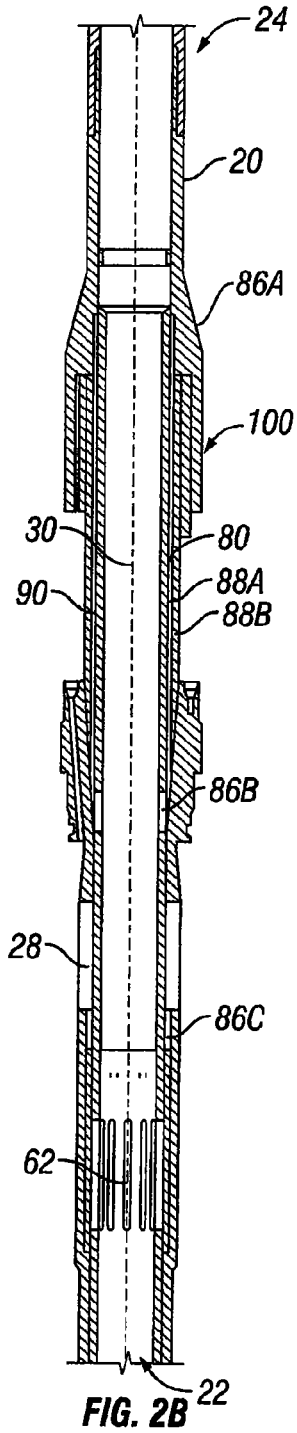

Turning now to FIGS. 2A and 2B, the hydraulic actuation system of the embodiment illustrated in FIG. 1 will be described. First, it will be noted that FIG. 2A illustrates the valve 10 in the opened condition and FIG. 2*b* illustrates the valve 10 in the closed condition. A plurality of seals systems 86 (e.g., 86B and 86C) seal the sleeve 60 to the valve body 20 about the body flow ports 28 to substantially prevent fluid communication from outside the valve 10 to the inside 30 of the valve 10.

The body 20 comprises a first manifold portion 32 located adjacent the proximal end 24. The manifold portion 32 comprises a valve closing control circuit 34 that communicates with the chamber 80 and more specifically with closing working surface 82. The exposed junction of the valve closing circuit 34 is adapted to receive a control line fitting 36, such as a Levy fitting. The manifold portion 32 may also comprise one or more channels or grooves adjacent the outside surface, opened or closed, for receiving and routing one or more control lines, such as control line 38. In this particular embodiment, the manifold portion 32 also comprises a bypass relief system 100, which will be explained more fully below.

The body 20 comprises a second manifold portion 40 located adjacent the distal end 22. The manifold portion 40 comprises a valve opening control circuit 42 that communicates with the chamber 80 and more specifically with opening working surface 82. The exposed junction of the valve opening circuit 42 is adapted to receive a control line fitting 36, such as a Levy fitting. A control line 44 is shown (partial view) connected to the opening circuit 42. Also shown in manifold portion 40 is an annulus monitor circuit 46. It will be appreciated that the valve 10 may be opened by creating a pressure differential in the chamber 80 across the working surfaces 82 such that the sleeve 60 moves up or toward the proximal end 24. Similarly, the valve 10 may be closed by creating a pressure differential in the reverse direction to cause the sleeve 60 to move downward. In addition, it will appreciated that the valve 10 may be operated by standard mechanical means, such as a shifting tool (not shown) cooperating with opening and/or closing profiles (not shown) on the sleeve 60.

Figure 3:
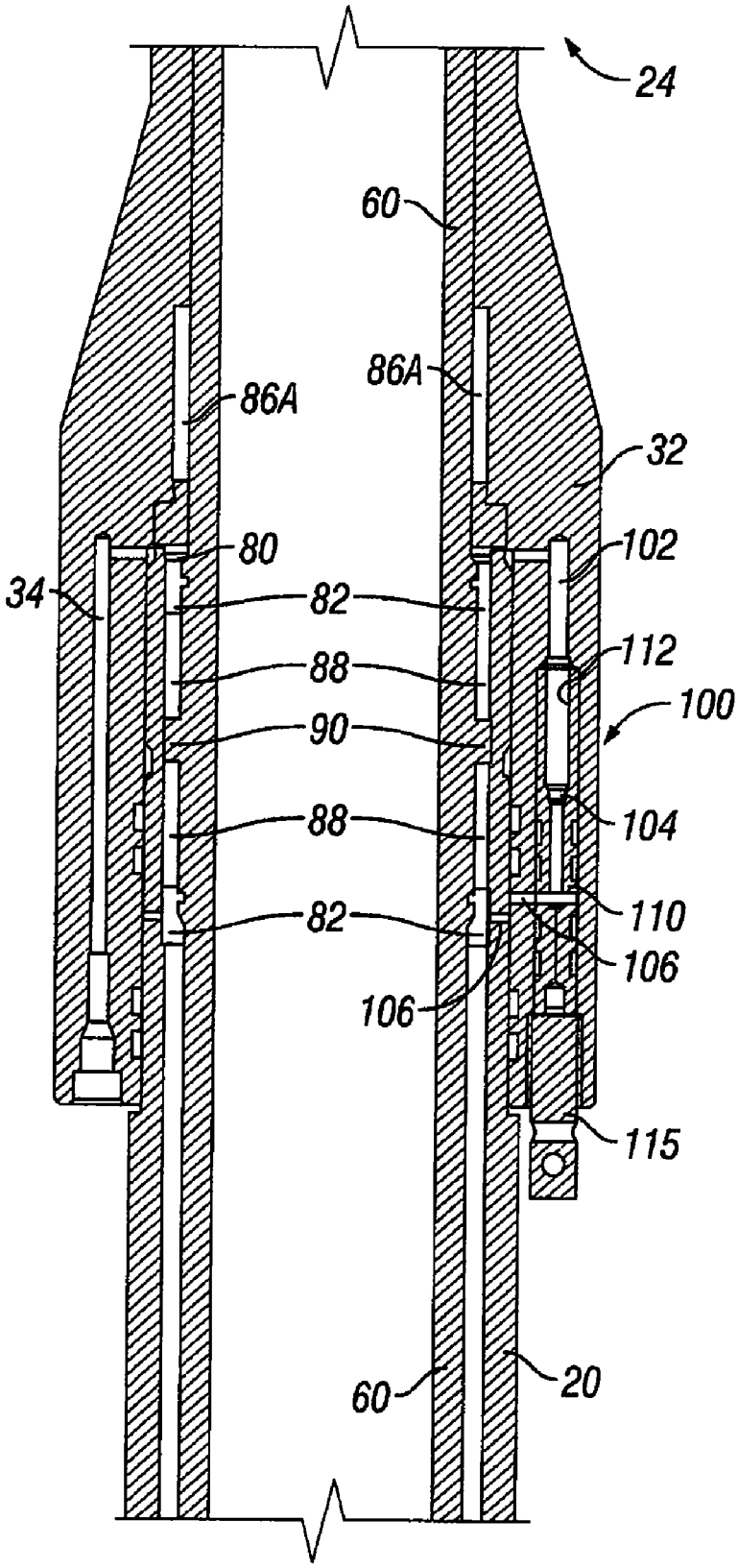
FIG. 3 illustrates a sectional view of a manifold portion of the valve illustrated in FIG. 1.

FIG. 3 illustrates the manifold portion 32 of the valve 10 and, more particularly, the bypass and relief system 100. Prior art hydraulic sleeve valves often times become stuck or fouled and did not fully open or close as designed. The embodiments illustrated in FIGS. 1-3 comprise a sleeve position indicator in the form of a bypass relief system 100. In this embodiment, the bypass relief 100 can indicate whether the valve 10 has achieved the fully opened condition. As shown in FIG. 3, the bypass relief 100 comprises a closing circuit passage 102; a relief valve assembly 104, and a bypass circuit 106 formed in the body 20 adjacent the relief valve assembly 104.

Figure 4:
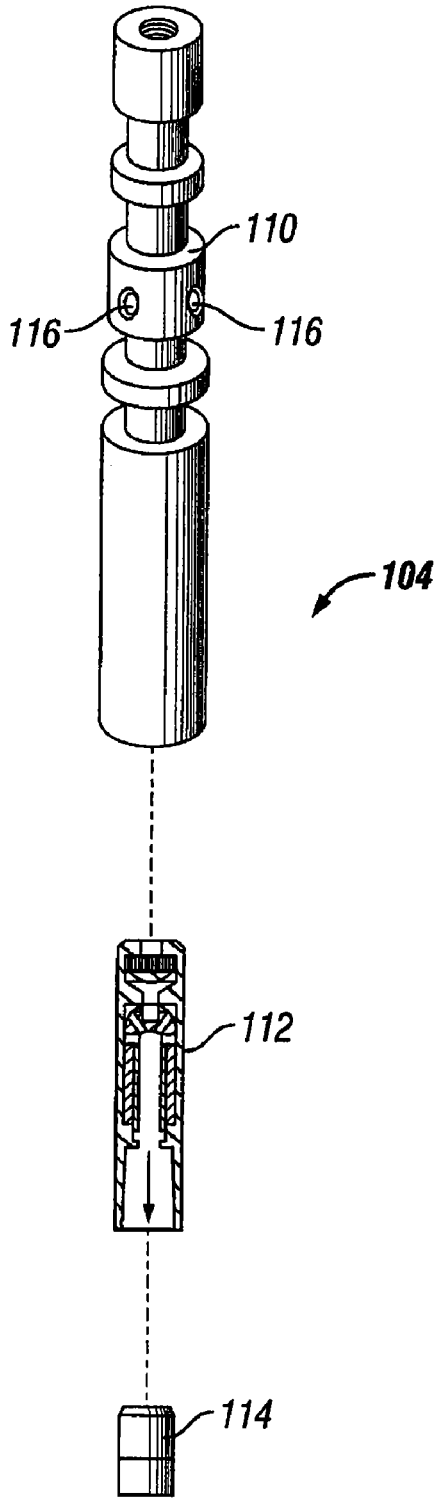
FIG. 4 illustrates an exploded view of portions of a bypass relief system suitable for use with embodiments of the present inventions.
Figure 5:
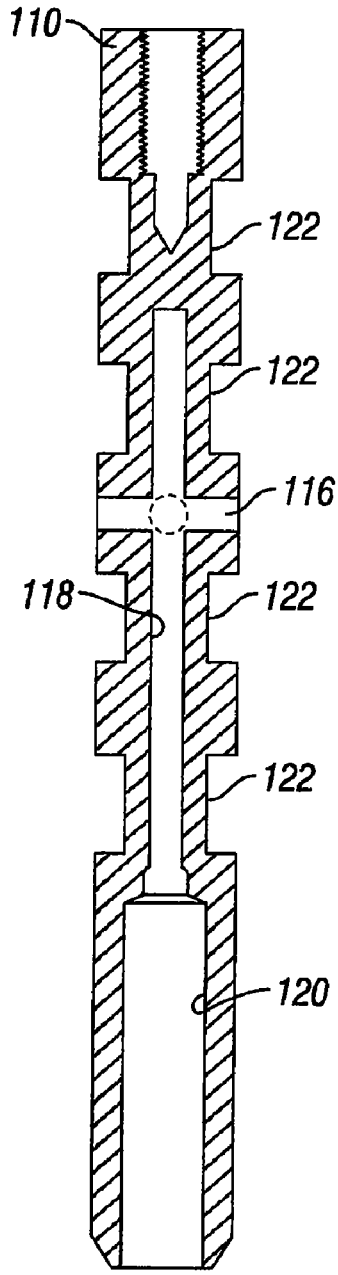
FIG. 5 illustrates a sectional view of a spool body illustrated in FIG. 4.

Referring to FIGS. 4 and 5, a relief valve assembly 104 suitable for use with a valve 10 comprises a spool body 110, a cartridge-type reverse flow relief valve 112, locking sleeve 114, and bull plug 115 (see FIG. 3). The spool body 110 is generally cylindrical in shape and is adapted to reside in a corresponding cavity in the manifold portion 32. The spool body 110 is configured such that one or more fluid ports 116 are in fluid communication with bypass circuit 106 when the spool body 110 is in position. The one or more fluid ports 116 communicate with a spool bore 118 (see FIG. 5), which in turn communicates with a relief valve receptacle 120. The spool body 110 may comprise retaining grooves 122 for retaining a spool body seal system, such as elastomeric seals or seals systems utilizing PEEK, PEKK, PTFE, or other such systems. It is preferred to have a seal system on either side of the fluid ports 116 and more preferably to have two seal systems on either side of the fluid ports 116, as illustrated in FIGS. 4 and 5.

The cartridge-type, relief valve 112 illustrated in FIG. 4 may be of the type available from The Lee Company of Westbrook, Conn. A presently preferred embodiment of the relief valve 112 is The Lee Company's part number PHRA2815300D . This particular relief valve has a minimum shut off pressure of 2850 psid and a minimum crack pressure of 3000 psid. The relief valve 112 is received in the receptacle 120 in spool body 110. A locking sleeve 114 is driven into the interior of the relief valve 112, which expands the relief valve 112 body into gripping engagement with the spool body 110. It will be appreciated that while the presently preferred embodiment employs a third-party cartridge-type relief valve, functionally similar relief valves and/or check valves (spring loaded or free floating) can be purchased or fabricated for use in hydraulic sleeve valves incorporating one or more of the present inventions.

Referring back to FIG. 3, a bull plug 115 is connected, such as by threading, to the spool body 110. The assembled bypass relief system 100 is inserted into the corresponding cavity in the manifold portion 32 and coupled thereto, such as by threading. As shown in FIG. 3, the bypass circuit 106 communicates into the chamber 80, thereby establishing fluid communication from the chamber 80, through the bypass circuit 106, into the spool assembly 104, through fluid ports 116 and bore 118, through the relief valve 112, into the closing circuit passage 102, and back into the chamber 80.

The bypass circuit 106 is preferably positioned into the chamber 80 such that the opening working surface 82 (and associated seals 88, as applicable) expose the bypass circuit 106 to opening pressure immediately prior to or at the valve 10 fully opened condition.

In operation, as the sleeve 60 is moved by differential pressure from its closed position to its opened position, the bypass circuit 106 will become exposed to the pressure in the opening circuit 42 (via the portion of the chamber 80 distal of the opening working surface 82). Once the bypass circuit 106 is so exposed, fluid communication is established between the opening circuit 42 and the closing circuit 34. A predetermined pressure drop in the opening circuit 42 is the positive indication that the sleeve 60 has reached the fully opened position (or substantially opened position depending on how the valve 10 is designed). Because the relief valve 112 has a minimum crack off or flow pressure of 3000 psid, sufficient differential pressure remains on the opening working surface 82 to preclude the valve 10 from inadvertently closing. Once the valve 10 is opened and the bypass relief system 100 is activated, the control fluid may be circulated through the control system (not shown) to filter out or remove selected contaminants that may have entered the control lines. It will be appreciated that in the embodiment described above, control fluid circulation is accomplished any time the valve is in the opened condition and a valve-opening pressure differential is applied to the sleeve 60.

Those of skill in the art will appreciate that control fluid contamination, such as by gas infiltration, may be minimized by optimizing the seal systems used on the valve 10. For example, a Tec-Pac seal system, such as those readily available from TEI Sealing Systems and similar seal vendors may be suitable for use with embodiments of the present inventions. Additionally, uses of elastomeric seals are well known to minimize gas infiltration. However, because the present invention allows the control fluid to be circulated to remove contaminants, such as air or gas, optimization of the seal may not be necessary in some or all applications.

When it is desired to close the valve 10, a valve-closing pressure differential is applied through the control lines 38 and 44. It will be appreciated that, because the relief valve 112 is a one-way flow valve, there will be no fluid communication between the areas of high pressure and low pressure in the chamber 80 during closing.

Thus, the embodiments described and illustrated in FIGS. 1-5 achieve the benefits of the present inventions concerning providing a positive indication, or tell-tale, of valve 10 position (e.g., fully opened) and allows the control fluid to be circulated to bleed air from the lines, remove contaminants, and other such functions. Now having the benefit of this disclosure, persons of skill in the art will readily appreciate that a valve 10 can be constructed such that the tell-tale system functions to indicate when the valve is fully or substantially-fully closed. Also, those persons will now understand how to construct a valve 10 having tell-tale functionality (and circulation functionality) at both the fully opened and/or fully closed positions.

Figure 6A:
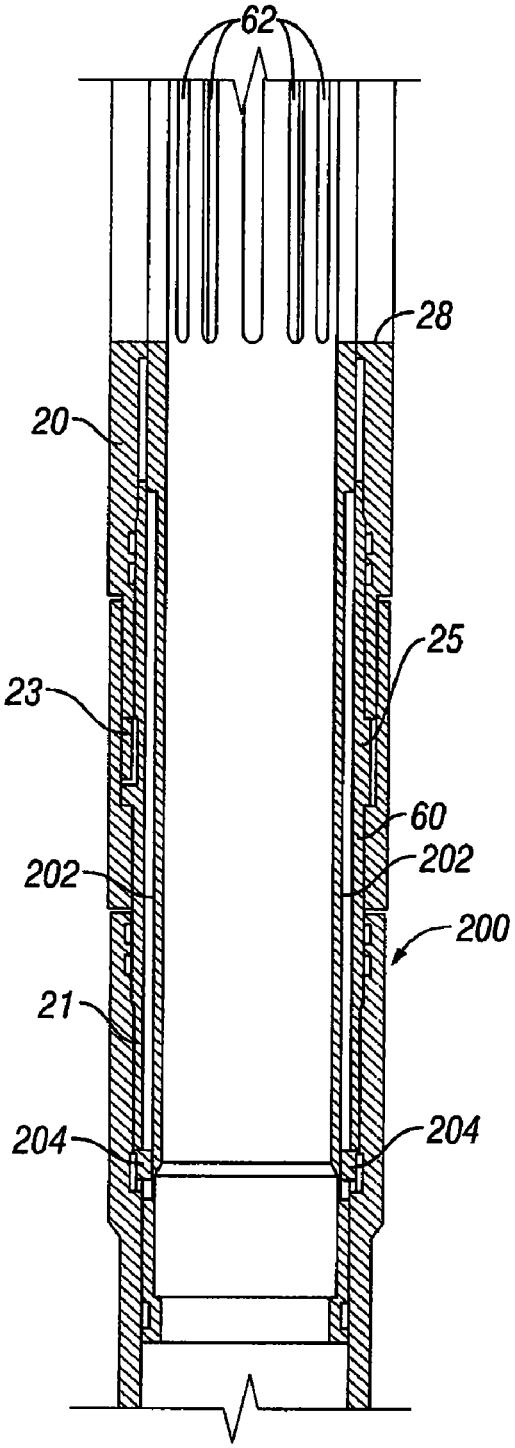
FIGS. 6A and 6B illustrate a flow port alignment system suitable for use with embodiments of the present inventions.

Another functionality of the present invention is illustrated in FIGS. 6A*a* and 6B for those embodiments that have sleeve flow ports, it is oftentimes (if not always) desirable to ensure little to no flow restriction or pressure drop through the valve 10 flow ports (e.g., 28, 62). This can be accomplished by correctly sizing the flow ports relative to the main tubing flow area as is well known in the art. However, if the flow path between the valve body ports 28 and sleeve ports 62 becomes obstructed, such as may happen if the ports do not align properly, undesirable flow restrictions and/or pressure drops may arise. The present invention may comprise a flow port alignment system 200 that maintains the relative alignment between the body ports 28 and the sleeve ports 62 while the valve 10 is opened. A preferred embodiment of the flow port alignment system 200 is illustrated in FIGS. 6A and 6B.

Figure 6B:
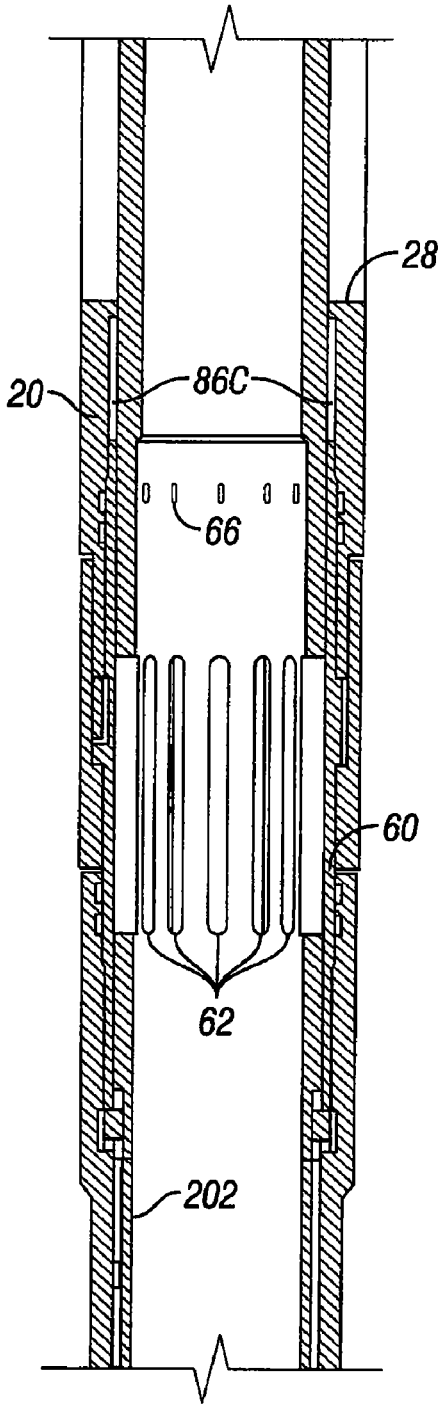

FIG. 6A illustrates the valve 10 in the opened condition (i.e., ports 28 and 62 are in fluid communication) and FIG. 6B illustrates the valve 10 in the closed condition. A portion of the sleeve 60 distal of the flow ports 62 comprises one or more grooves or channels 202. Coupled to a portion 21 of the body 20 adjacent the distal end 22 and the sleeve grooves 202 is an alignment system comprising one or more alignment pins or lugs 204. The alignment pins 204 are adapted to reside within the sleeve grooves 202 to maintain the alignment of the sleeve 60 with the body portion 21 as described above. In a preferred embodiment, the alignment pins 204 and/or the sleeve grooves 202 are made from a galling-resistant material or have an anti-galling surface treatment applied thereto. It is presently preferred that alignment pins 204 be fabricated from a beryllium copper alloy, such as AT 25.

FIGS. 6A and 6B also illustrate that portion of the alignment system 200 between the body portion 21 and the body 20. This portion of the system 200 comprises a tongue 23 and groove 25 or interlocking finger structure to maintain the relative positional alignment between the body 20 and the body portion 21. Thus, the alignment system 200 maintains relative orientation between the body 20 and the sleeve 60 so that the body and sleeve flow ports, 28, 62, are always properly aligned.

It will be appreciated that the alignment system illustrated in FIGS. 6A and 6B prevent relative misalignment between the sleeve 60 and body 20 through out the length of the sleeve's axial stroke. Other embodiments of the alignment system 200 may accomplish flow port alignment only when the valve is the fully opened position. For example, one alternate embodiment may comprise sleeve grooves that spiral or helix about the sleeve such that the sleeve ports 62 and body ports 28 are not aligned or may be partially obstructed until the valve is fully opened. Another alternate embodiment may comprise an alignment system 200 that is only active just prior to the valve 10 being fully opened. At other times or positions, the sleeve ports 62 and body ports 28 may be unaligned and/or the sleeve 60 may be free to rotate relative to the body 20.

Figure 7:
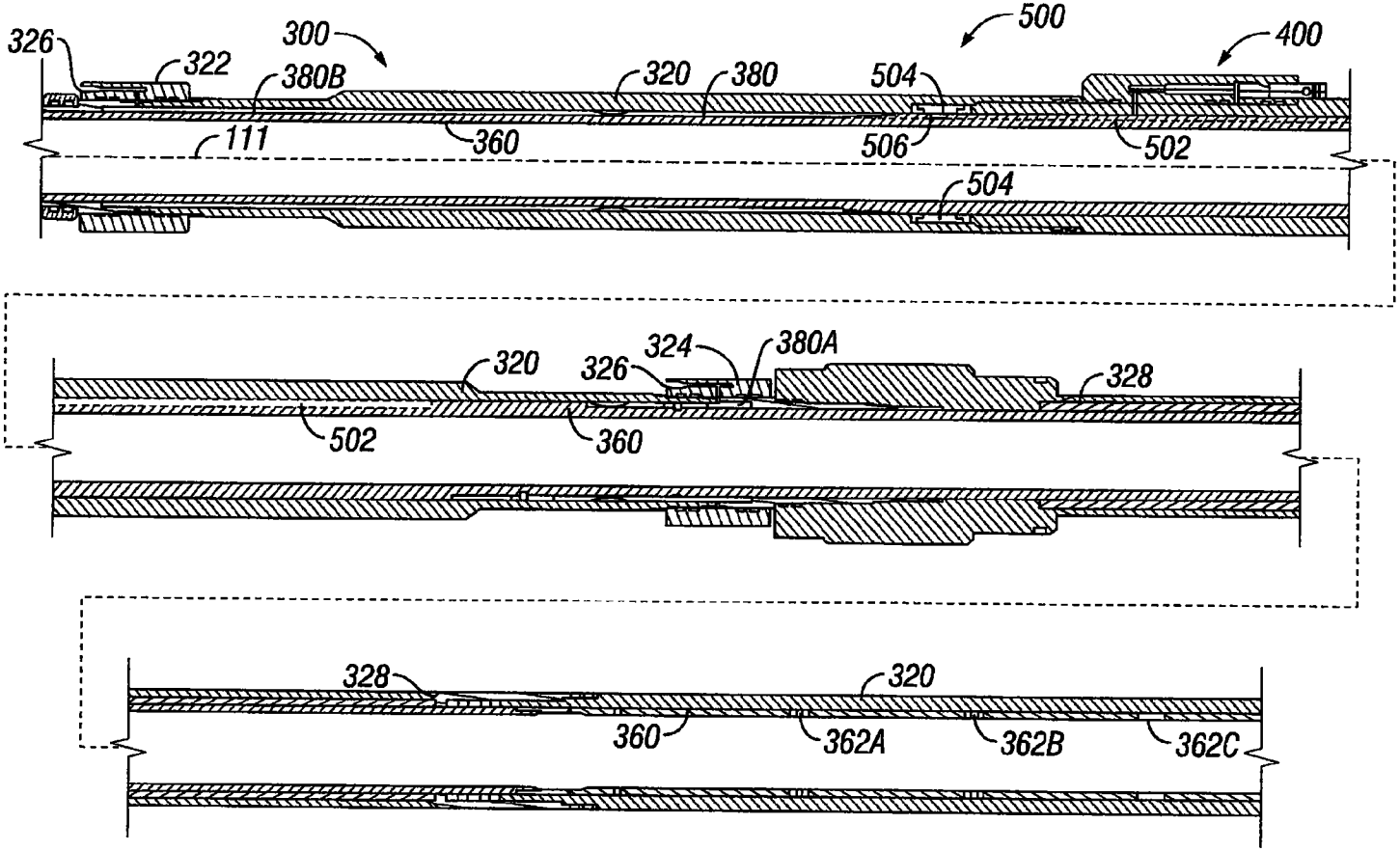
FIG. 7 illustrates a sectional view of another hydraulic sleeve valve embodiment incorporating various aspects of the present inventions.

Another embodiment of a hydraulic sleeve valve 300 is illustrated FIG. 7. The valve 300 comprises a body 320, which may be, and preferably is, made of several sub-portions to aid the assembly of the tool. Within the body 320 and fluidly sealed thereto is a sliding sleeve 360. Formed between the body 320 and the sleeve 360 is a pressure chamber 380. A portion of the sleeve 360 divides the chamber 380 into an opening pressure chamber 380A and a closing pressure chamber 380B. The body 320 further comprises a closing manifold 322 and an opening manifold 324. Hydraulic control lines (not shown) may be connected to the manifolds at fittings 326. Valve 300 may also comprise a bypass relief system 400, such as, but not limited to the bypass relief system 100 discussed above.

Rather than the alignment system 200 discussed above, the embodiment illustrated in FIG. 7 comprises a flow port alignment system in the form of a position indexing system 500. Preferably, this indexing system 500 comprises a programmed track 502 (see FIG. 8) associated with the sleeve 360. The body 320 comprises a corresponding follower system 504. The follower system 504 may preferably comprise a ring adapted to float freely with respect to the body 320 and which may have one or more protruding members 506 to engage the programmed track 502 and associated bearing systems. The protruding member 506 and/or bearings may be fabricated from a galling resistant or anti-galling coated material as discussed previously with respect to alignment pin 204.

Figure 8:
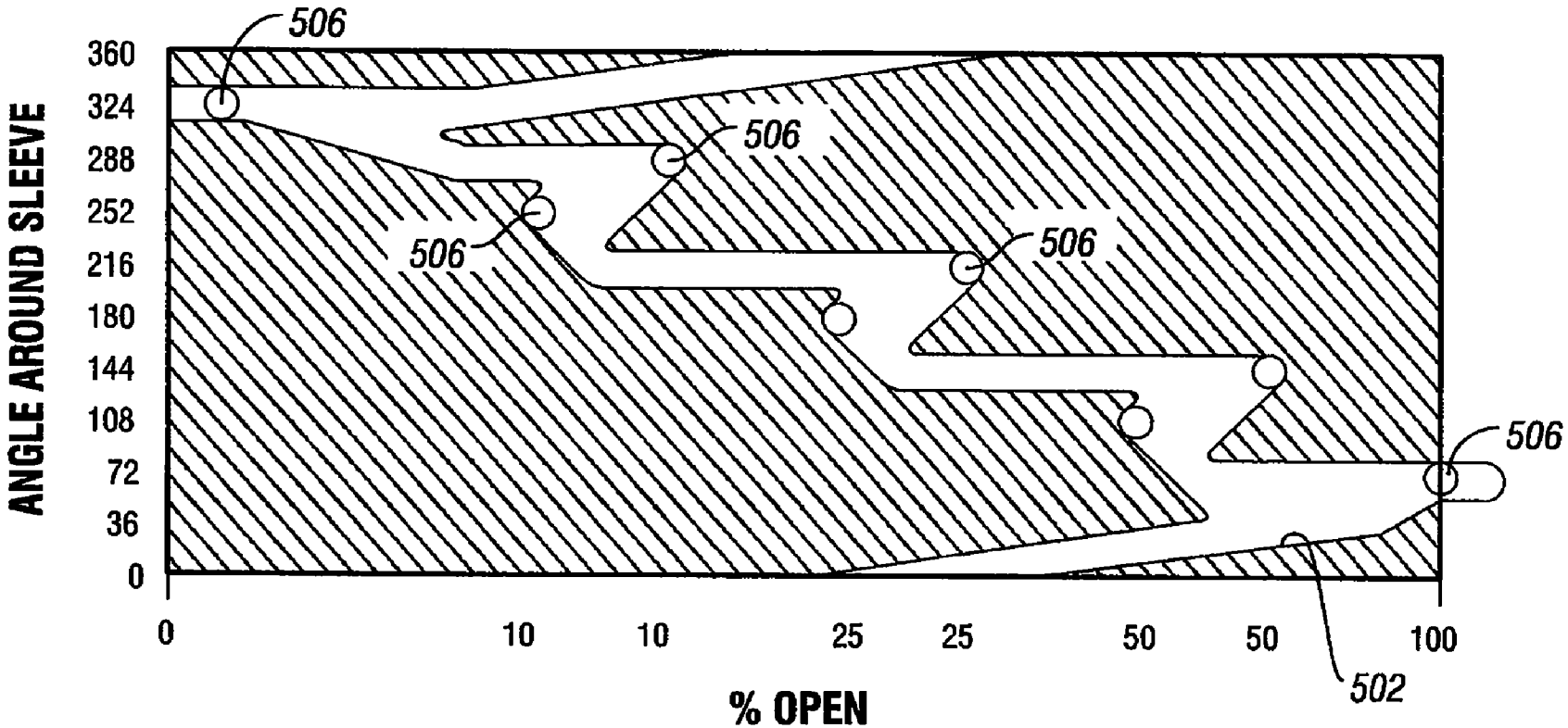
FIG. 8 illustrates a planar view of a position indexing system suitable for use with embodiments of the present inventions.

Referring now to FIG. 8, a programmed track 502 is illustrated in a planar view. The protruding member 506 is shown in multiple positions relative to the track 502. As the sleeve is actuated up or down by control line pressure, the track 502, which may be coupled to or integral with the sleeve 360, moves up or down relative to the member 506 and, therefore, relative to the body 320. As is known in the art, the programmed track illustrated in FIG. 8 causes the sleeve 360 to rotate relative to the body 320 as the sleeve 360 translates axially. Thus, in the embodiment illustrated in FIG. 7, the position indexing system 500 functions similarly to flow port alignment system 200 illustrated in FIGS. 6A and 6B. In addition, however, the position indexing system 500 offers the valve designer and end user a wider selection of flow areas to choose from. As shown in FIG. 8, the valve user may open the valve 300 to, for example, 10%, 25%, 50% or 100% of the valve's 320 total flow area by positioning the sleeve ports 362 relative to body ports 328 according to the programmed track 502. Valve designers may create hydraulic valves according to the present inventions having a wide variety of flow port positions and flow conditions.

As illustrated in FIG. 7, the sleeve 360 may comprise one or more sets of a plurality of flow ports 362. FIG. 7 illustrates a preferred embodiment of a sleeve 360 for use with the position indexing system 500 illustrated above. The sleeve 360 comprises a first set of flow ports 362A, a second set of flow ports 362B located distally of the first set 362A, and a third set 362C located distally of the second set. FIG. 7 also illustrates that the body ports 328 may be sized to account for the axial spacing of the sleeve ports 362A-C so that the body port 328 is long enough to encompass all three sets of ports for the fully opened condition. With the benefit of this disclosure, those of skill in the art will now understand how to make and use a hydraulic sleeve valve having one or more flow conditions based on sleeve position along with a positive indication of valve state (such as, but not limited to, fully open or fully closed) and/or control line circulation.

Persons of skill in the art will also appreciate that a plurality of hydraulic valves utilizing one or more of the inventions illustrated herein can be deployed in a given formation zone. Valve position indexing systems can be implemented in each valve such that common control lines open all valve simultaneously and close all valves simultaneously. Alternately, each separate valve in the formation zone may have separate control lines for independent control. Alternately, a valve position indexing system can be implemented in each valve such that actuation from a common set of control lines causes one valve to open first (fully or partially) on the first pressure cycle followed by additional openings on the second pressure cycle (such as, but not limited to, fully opening the first valve and partially opening the second valve) and so on.

Figure 9A:
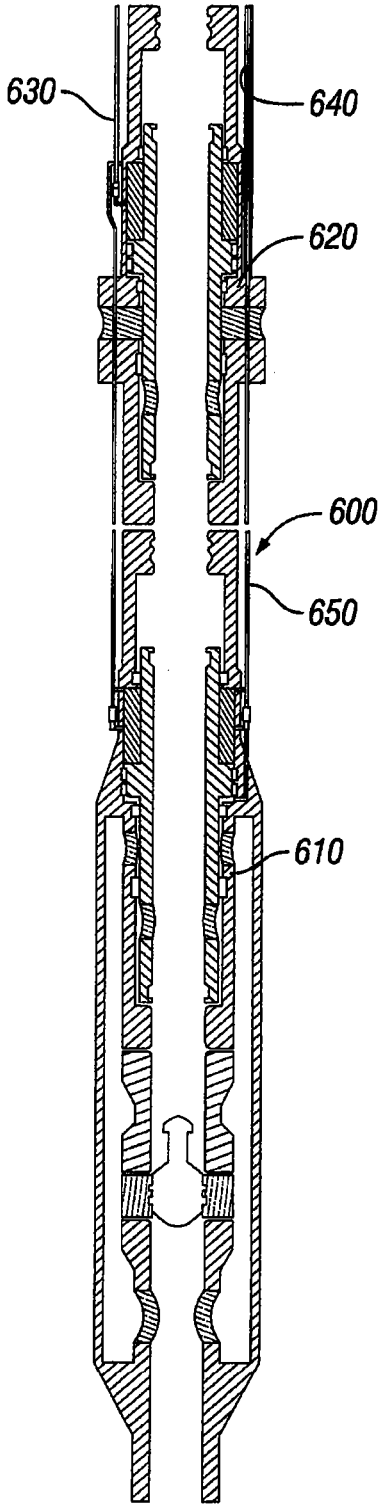
FIG. 9A-D illustrate a downhole assembly, comprising a plurality of hydraulic sleeve valves according to the present inventions, in various flow conditions.
Figure 9B:
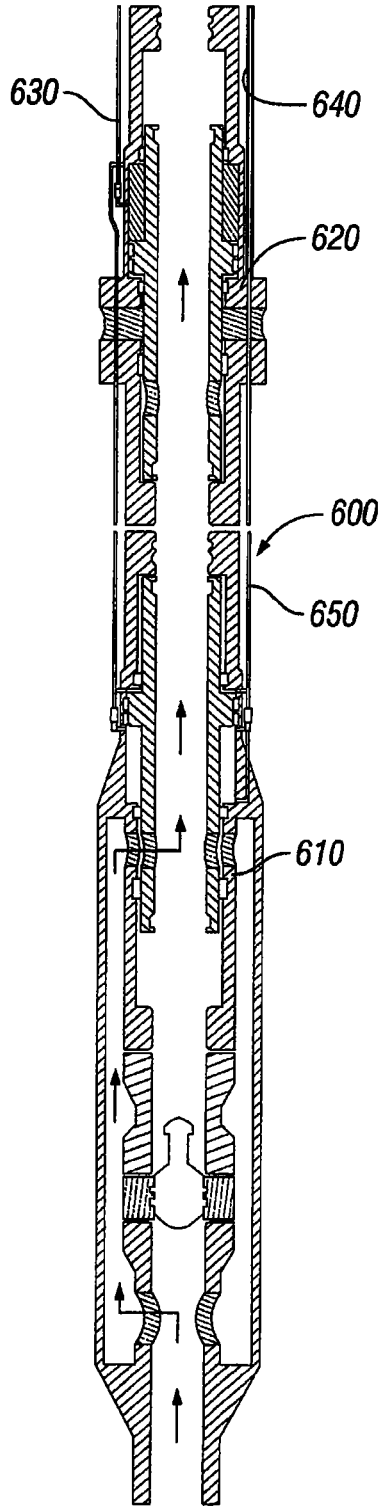
Figure 9C:
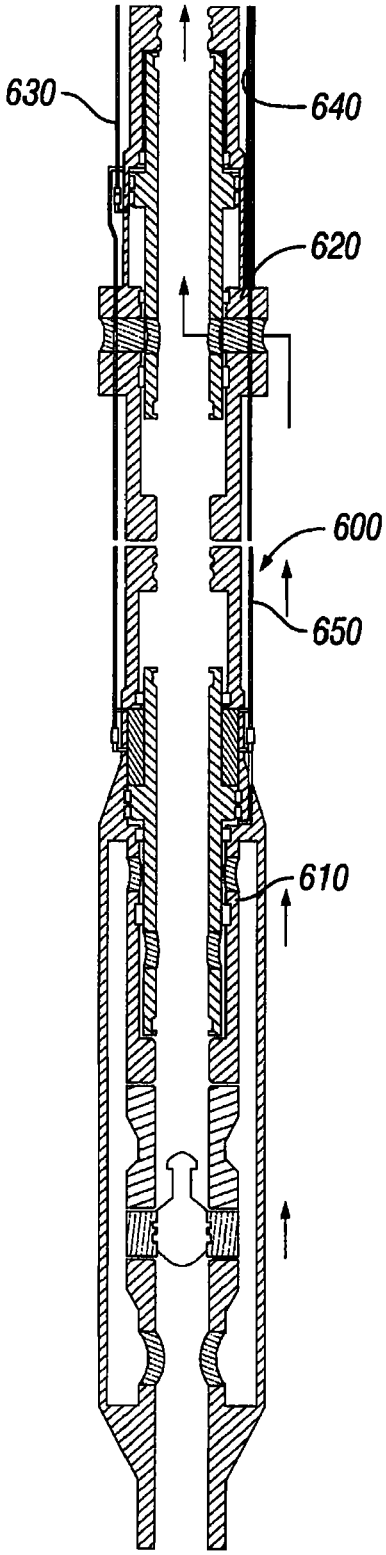
Figure 9D:
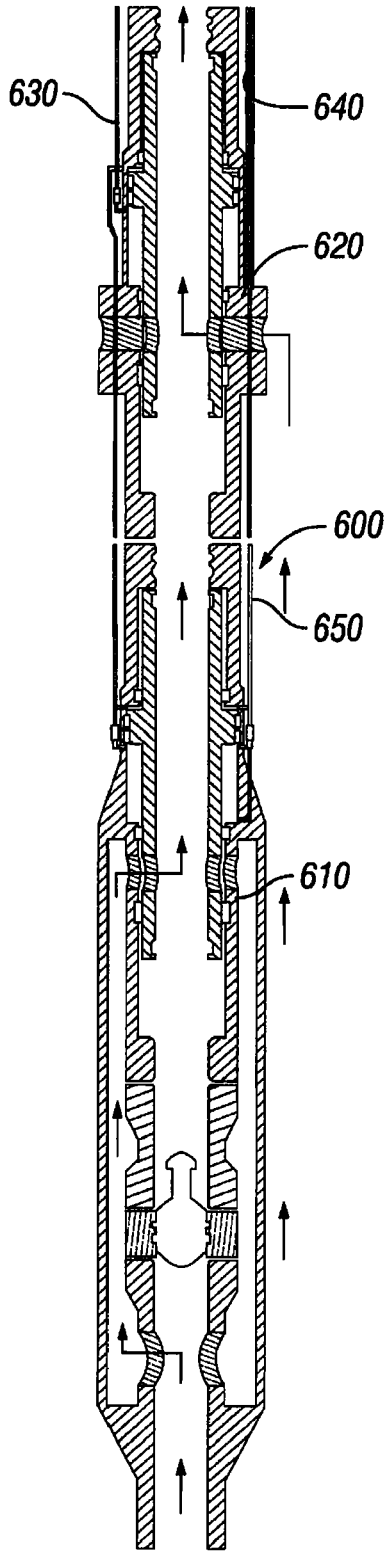

FIGS. 9A-9D illustrate a downhole assembly 600 comprising at least two hydraulic sleeve valves 610, 620 incorporating the present inventions. FIG. 9A is nominated "Position I" and illustrates both valves 610, 620 in the closed condition. As can be inferred from the indicated flow arrows, FIG. 9B, nominated "Position II," illustrates valve 610 in the opened condition and valve 620 in the closed condition. FIG. 9C, nominated "Position III," illustrates valve 610 in the closed condition and valve 620 in the opened condition. FIG. 9D, entitled "Position IV," illustrates both valves 610, 620 in the opened condition. In all of FIG. 9, control line 630 is also identified as "RSSR;" control line 640 is identified as "RSSU;" and control line 650 is identified as "RSSL."

FIG. 10 illustrates a valve shifting sequence chart for the downhole assembly illustrated FIG. 9. Column 1 lists the desired valve transitions. For example, row A lists the transition of the downhole assembly from Position I (FIG. 9A, all closed) to Position II (FIG. 9B, lower valve opened, upper valve closed). Column 2 shows the starting state of the valves, and column 4 shows the ending state. Column 3 shows the sequence of operations to achieve the desired valve transition.

For example, to transition the downhole assembly illustrated in FIG. 9 from Position I to Position II, the following sequence of operations may be followed. First, all of the control lines are vented. Next, approximately 3000 psi is applied to control line 630 (RSSR) and control lines 640 and 650 are monitored. This ensures that both valves 610, 620 are closed. Thereafter, the control lines are once again vented, and then approximately 3000 psi is applied to control line 650 (RSSL) to open the lower valve 610. Movement of the sleeve in valve 610 displaces about 513 cc of control fluid through control line 630. The total control line fluid displacement for this operation is about 2 gallons for every 1000 feet of depth. The control lines are vented and the downhole assembly is now in Position II (FIG. 9B). Other valve transitions may be accomplished as illustrated in FIG. 10. Those of skill in the art will now appreciate that one or more hydraulic sleeve valves embodying one or more of the present inventions can be used to construct a "smart" or "intelligent" downhole system or assembly that can be selective and remotely controlled, thereby minimizing expensive and potentially dangerous mechanical interventions into the wellbore.

All of the methods, processes and/or apparatus disclosed and claimed herein can be made and executed without undue experimentation in light of the present disclosure. While the methods and apparatus of this invention have been described in terms of preferred embodiments, it will be apparent to those of skill in the art that variations may be applied to the methods, apparatus and/or processes, and in the steps or in the sequence of steps of the methods described herein without departing from the concept and scope of the invention. More specifically, it will be apparent that certain features which are both mechanically and functionally related may be substituted for the features described herein while the same or similar results would be achieved. All such similar substitutes and modifications apparent to those skilled in the art are deemed to be within the scope and concept of the invention.

What is claimed is:

1. A hydraulic valve assembly for use in a subterranean well comprising:

a body portion including a flow port therethrough;

a sleeve axially slidably disposed adjacent an inside surface of the body portion and forming a sealed pressure chamber there between, the sleeve comprising a working surface disposed in the pressure chamber and separating the chamber into a valve opening portion and a valve closing portion;

a flow port through a portion of the sleeve such that when the body flow port and the sleeve flow port are aligned, the valve permits fluid communication from outside of the body to inside of the sleeve; and a bypass relief system adapted to fluidly communicate between the valve opening and closing portions of the chamber when the sleeve is in a predetermined axial position.

2. The valve assembly of claim 1, wherein the bypass relief system comprises a one-way pressure relief valve disposed in a bypass conduit having an opening pressure port and a closing pressure port.

3. The valve assembly of claim 2, wherein the closing pressure port communicates with the closing chamber portion when the valve is fully opened, and wherein communication of the opening pressure port with the opening chamber portion occurs just prior to or when the valve is in the fully opened condition.

4. The valve assembly of claim 3, wherein communication of the opening pressure port with the opening chamber portion causes an indication discernible by a valve user that the valve is substantially fully opened.

5. The valve assembly of claim 4, wherein the indication is a change in hydraulic pressure used to open the valve.

6. The valve assembly of claim 3, wherein fluid used to open and/or close the valve may be circulated through the valve when the opening pressure port and the opening chamber portion are in fluid communication.

7. The valve assembly of claim 2, wherein the opening pressure port communicates with the opening chamber portion when the valve is fully closed, and wherein communication of the closing pressure port with the closing chamber portion occurs just prior to or when the valve is in the fully closed condition.

8. The valve assembly of claim 7, wherein communication of the closing pressure port with the closing chamber portion causes an indication discernible by a valve user that the valve is substantially fully closed.

9. The valve assembly of claim 8, wherein the indication is a change in hydraulic pressure used to close the valve.

10. The valve assembly of claim 7, wherein fluid used to open and/or close the valve may be circulated though the valve when the closing pressure port and the closing chamber portion are in fluid communication.

11. The valve assembly of claims 1 or 2, further comprising a flow port alignment system for positively aligning the body flow port and sleeve port for a desired amount or type of fluid communication through the valve.

12. A hydraulic valve assembly for use in a subterranean well comprising:

a body portion including a flow port therethrough;

a sleeve axially slidably disposed adjacent an inside surface of the body portion and forming a sealed pressure chamber there between, the sleeve comprising a working surface disposed in the pressure chamber and separating the chamber into a valve opening portion and a valve closing portion;

a flow port through a portion of the sleeve such that when the body flow port and the sleeve flow port are aligned, the valve permits fluid communication from outside of the body to inside of the sleeve; and a bypass relief system adapted to fluidly communicate between the valve opening and closing portions of the chamber when the sleeve is in a predetermined axial position, and comprising a one-way pressure relief valve disposed in a bypass conduit having an opening pressure port and a closing pressure port, both of which communicate with the pressure chamber.

13. The valve of claim 12, further comprising a flow port alignment system.

14. The valve of claim 13, wherein the flow port alignment system comprises a pin and groove structure disposed between the sleeve and the body to prevent the sleeve from rotating relative to the body thereby maintaining a predetermined alignment of the body port and the sleeve port.

15. The valve of claim 13, wherein the flow port alignment system comprises a sleeve position indexing system including a programmed track and follower for axially and/or rotationally positioning the sleeve port relative to the body port at a plurality of flow conditions.

16. The valve of claim 15, wherein the plurality of flow conditions includes no flow, partial flow, and full flow.

17. A method for valving fluid flow in a subterranean well:

providing a hydraulic valve at a desired location in the well, the valve comprising a body portion including a flow port therethrough; a sleeve axially slidably disposed adjacent to an inside surface of the body portion and forming a sealed pressure chamber there between, the sleeve comprising a working surface disposed in the pressure chamber and separating the chamber into a valve opening portion and a valve closing portion; a flow port through a portion of the sleeve such that when the body flow port and the sleeve flow port are aligned, the valve permits fluid communication from outside of the body to inside of the sleeve; and a bypass relief system adapted to fluidly communicate between the valve opening and closing portions of the chamber when the sleeve is in a predetermined axial position;

supplying fluid pressure to the valve to change its flow condition from closed to opened or opened to closed; and generating an indication with the bypass relief system to inform the valve user that the valve has cycled to the desired flow condition.

18. The method of claim 17, wherein the valve is cycled to the opened condition.

19. The method of claim 18, wherein the indication is a change in the fluid pressure used to open the valve.

20. The method of claim 17, further comprising maintaining a predetermined alignment between the body and sleeve flow ports at a plurality of axial positions of the sleeve.

* * * * *